US009029673B2

(12) United States Patent
Kaynor

(10) Patent No.: US 9,029,673 B2
(45) Date of Patent: May 12, 2015

(54) HARMONICA SUPPORT WITH MAGNETIC CRADLE

(71) Applicant: Peter Kaynor, Cedar, MI (US)

(72) Inventor: Peter Kaynor, Cedar, MI (US)

( * ) Notice: Subject to any disclaimer, the term of this patent is extended or adjusted under 35 U.S.C. 154(b) by 0 days.

(21) Appl. No.: 14/563,924

(22) Filed: Dec. 8, 2014

(65) Prior Publication Data

US 2015/0090097 A1 Apr. 2, 2015

Related U.S. Application Data

(63) Continuation of application No. 13/590,517, filed on Aug. 21, 2012, now Pat. No. 8,940,987.

(60) Provisional application No. 61/527,010, filed on Aug. 24, 2011.

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 7/123
USPC ..... 84/379
See application file for complete search history.

(56) References Cited

U.S. PATENT DOCUMENTS 1,535,206 A 4/1925 Davidson
1,722,852 A * 7/1929 Miller ..... 84/377
1,734,799 A 11/1929 Elkington
1,762,645 A 6/1930 Spalleno
1,912,654 A 6/1933 Peterson
1,954,169 A 4/1934 Futer
2,171,128 A 8/1939 Koons
2,384,758 A 9/1945 Magnus
3,172,328 A 3/1965 Haile
3,818,792 A 6/1974 Gerbetz
4,212,219 A 7/1980 Hubbard
4,287,803 A 9/1981 Zema
4,319,097 A 3/1982 Liautaud
4,397,213 A 8/1983 Hubbard
4,402,249 A * 9/1983 Zankman ..... 84/453
4,414,879 A 11/1983 Ruiz
4,541,321 A 9/1985 Miner
4,713,999 A 12/1987 Burt
4,739,686 A 4/1988 Doll
5,104,081 A 4/1992 Sparks
5,479,841 A 1/1996 Garrett
5,608,177 A 3/1997 Zadworny
5,619,001 A 4/1997 Pasin (Continued)

FOREIGN PATENT DOCUMENTS

WO WO 00/26894 A1 5/2000

*Primary Examiner* — Kimberly Lockett
(74) *Attorney, Agent, or Firm* — Karel Lambert; Lambert Patent Service LLC

(57) ABSTRACT

A magnetic harmonica cradle having a fixed support surface that has been magnetized so as to securely hold a harmonica on the support surface when played without hands. An anterior raised lip is associated with the support surface and is configured to prevent the harmonica from slipping away from the mouth of the musician. A preferred magnetic cradle also permits the musician to grasp the harmonica in place, such as with a cupping motion for modulating the sound, or in a picking up motion for dismounting and/or exchanging the harmonica without the necessity for a mechanical release or latching mechanism which would slow the process or require tools and additional adjustment.

9 Claims, 17 Drawing Sheets

100

(56) References Cited

U.S. PATENT DOCUMENTS

| | | | |
|---|---|---|---|
| 5,635,656 | A | 6/1997 | Bowden |
| 5,929,352 | A | 7/1999 | Gutc |
| 7,091,408 | B2 | 8/2006 | Thibodeau |
| 7,638,698 | B1 | 12/2009 | Bellissimo |
| D633,554 | S | 3/2011 | Nguyen |
| 8,450,588 | B2 | 5/2013 | Applegate |
| 2003/0154844 | A1 | 8/2003 | Smith |
| 2013/0032020 | A1 | 2/2013 | Applegate |
| 2013/0233146 | A1 | 9/2013 | Applegate |

* cited by examiner

100

100

100

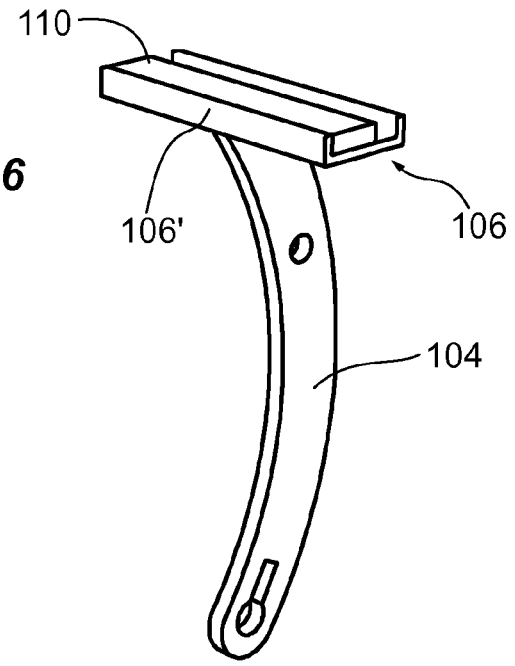
Fig. 6
Fig. 7A
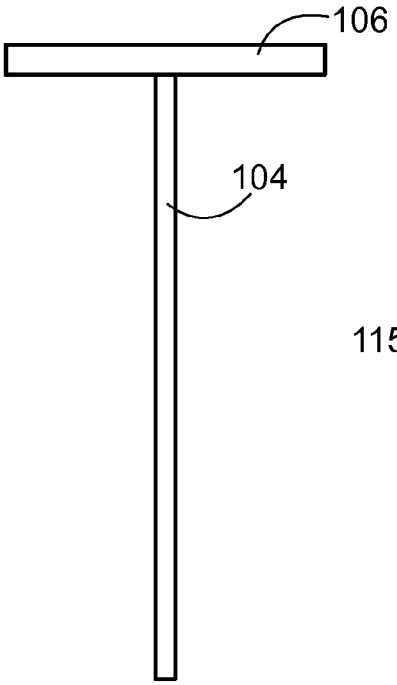
Fig. 7B
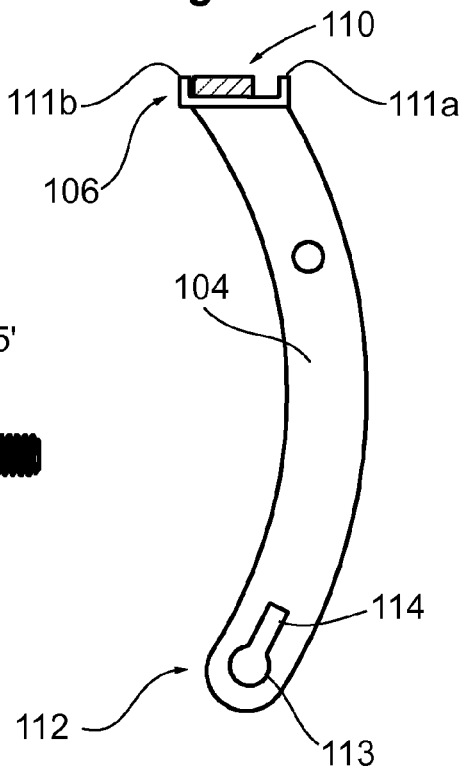
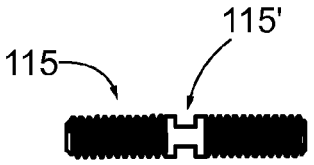
Fig. 7C

400

400

HARMONICA SUPPORT WITH MAGNETIC CRADLE

CROSS REFERENCE TO RELATED APPLICATIONS

This application is a Continuation of U.S. patent application Ser. No. 13/590,517, titled "Harmonica Support with Magnetic Cradle", filed Aug. 21, 2012, now U.S. Pat. No. 8,940,987; and claims priority to U.S. Provisional Patent No. 61/527,010, titled "Harmonica Support with Magnetic Cradle", filed Aug. 24, 2011; further wherein said patent documents are herein incorporated in full for all purposes.

FIELD OF THE INVENTION

This invention is related to an apparatus for ergonomically playing a harmonica while the musician's hands are otherwise occupied, and includes a magnetic cradle for the harmonica, a supporting frame with shoulder engaging member and harmonica pivoting member, and a memory locking hinge for pivoting the frame members between a preselected playing position and an at-rest position.

BACKGROUND

The present invention relates generally to hands-free playing of a harmonica, also termed a "mouth organ." The harmonica is traditionally a hand-held instrument. However, musicians who wish to play a harmonica while also playing another instrument are in need of a support frame for the harmonica which frees their hands. Using a support frame, the musician can also play a guitar, a horn, or hold a microphone, for example.

Shoulder-supported harmonica holders have been in use for over 100 years, and were initially fixed angle frames. As popularized by Bob Dylan in the 1960s, a typical modern harmonica holder incorporates the use of two pivoting sections, a harmonica supporting section and a shoulder engaging section, with provision for folding or pivoting the two sections to allow adjustment and also to fold the holder for transport.

Frames of the prior art having a variable pivot angle were realized using a fastener, such as a wing nut, to loosen, adjust and retighten the pivot angle between the two sections. A device of this type is illustrated in U.S. Pat. No. 5,608,177 (FIG. 1, no. 37). While this feature seems straightforward, the threaded fasteners are stripped by repeated use and the axle joint can slip unexpectedly when the musician leans into the harmonica. There is no remedy a musician can take once this has occurred, except to stop mid-performance and re-align and retighten the pivot angle. U.S. Pat. No. 5,619,001 (see FIG. 5, no. 68) offers a hinge joint having mating serrated tooth hubs which prevent slipping, but the threaded knob that forces the teeth into engagement requires both hands, first to select a position and tighten the hinge, test out the position relative to the mouth, and then readjust as necessary to find a preferred playing position, not a fully satisfactory solution.

Illustrated in U.S. Pat. No. 5,619,001 (see FIG. 2, nos. 18-26) is a spring-loaded harmonica mounting contraption that is both cumbersome to manage (requiring two hands to facilitate removal and installation of a harmonica to the holder) and to some degree or another detrimental to the aesthetic of the harmonica, its player's line of sight, the audiences' view of the player, and can slip or damage the harmonica. In one instance (the Sonnenschein SLK Harmonica Rack V2) a spring-tensioned, rubberized bar is used to clamp the harmonica, but the device is so large as to practically conceal the performer.

A similar structure is illustrated in U.S. Design Pat. No. D633554, although the clamping mechanism is somewhat indistinct and it would appear that the hinge release requires a tool for making adjustments and hence cannot be viewed as a quick release mechanism. A quick release feature has not been achieved that allows the musician to move a harmonica out of the way when desired, and to return the harmonica to a preferred playing position when needed. To be more useful, any quick release feature would benefit from an adjustably positionable locking mechanism with memory feature so that a preferred playing position preset by the musician ahead of time is not lost when the hinge is pivoted.

Also unrealized is a provision for mounting a second or backup harmonica on the frame; a second diatonic harmonica for example, which would be used extensively by musicians who's music changes key from one song to the next. The solution offered by U.S. Pat. No. 5,929,352 (and also U.S. Pat. No. 1,954,169), where clips are used to hold multiple harmonicas on a revolving wheel, would seem overly cumbersome and large.

Thus there are unresolved needs in the art; and a harmonica holder which overcomes the above and other disadvantages has long been sought.

SUMMARY

Disclosed is a harmonica holder with a "magnetic cradle" for hands-free playing of a harmonica. The apparatus comprises shoulder yoke adapted to be ergonomically worn over the shoulders of a musician; a harmonica support member adapted to be worn in front of the musician; the harmonica support member including a centrally positioned cradle for holding the harmonica; the cradle having a generally planar aspect and anteriosuperior raised lip for engaging an anterioinferior aspect of the harmonica; a magnetic member disposed in the cradle so that the cradle is magnetized with a pull force calibrated to hold the harmonica in the cradle during hands-free playing and to release the harmonica when not needed. Unexpectedly, the magnetic cradle was found to act on the magnetically susceptible coverplate of a harmonica without distorting the sound of the music. Magnetic cradles having a pull force of 7 to 15 pounds enable the musician to detachably place a harmonica in the cradle, and exchange that harmonica for a second harmonica. The magnetic force operates in concert with the raised lip to secure the harmonica for hands-free playing. By placing a second magnet on the harmonica holder frame, the second harmonica may be secured within easy reach.

Technologically, magnetically attaching fixtures would not be expected to be compatible with playing a harmonica. The vibrating parts that give the harmonica its sound, if influenced by the magnet, would presumably not function properly and the sound would be changed or weakened. However, the vibrating reeds or comb are typically made of brass and the soundbox is made of wood, and hence are not magnetically susceptible. Yet if the entire harmonica were made of brass or wood, there would be no attraction at all. Brass and wood are valued for musical instruments because they vibrate with richer tonal layers than steel and many musical instruments are made entirely of brass or wood. However, my testing has shown that a magnetic field does not interfere with or dampen the musical performance of a classical harmonica. The sound-making part of the harmonica is magnetically inert, but the coverplates of the harmonica are typically steel and hence can be affixed by a magnet instead of requiring holding the harmonica. Almost magically, the synergy of a magnetic cradle for playing a fixedly supported harmonica, given this peculiar and unique juxtaposition of materials, has not previously been realized and its realization here is an advance in the art.

Perhaps just as surprisingly, the magnetic harmonica holder of the invention is free of the squeaks, rattles, and clicks caused by metal-on-metal contact, as was noted as a disadvantage of prior art, spring-loaded harmonica holders by Doll (U.S. Pat. No. 4,739,686, col. 2 lines 11-14). It would be expected that a harmonica in contact with a magnet would also chatter or beat when played, but I have discovered that this is not so; that the sound quality of a magnetically affixed harmonica when played is equivalent or undampened when compared to that of a hand-held harmonica. Also, the magnetic cradle permits the user to grasp the harmonica with less interfering clamp structure, so that the sound can be manually modulated.

Doll, in the '686 reference, further teaches that the metal coverplates of the harmonica should not be contacted by the restraining members, indicating that such contacts "tend to product rattles, squeaks, clicks and the like." Thus the harmonica holder of the invention advantageously overcomes known disadvantages of the prior art, which would discourage and teach one skilled in the art away from the inventive solution I have found.

In another aspect of the invention, a second magnet may be disposed on the shoulder frame, the second magnet for magnetically securing the second harmonica within easy reach. This is advantageous for musicians who wish to use two or more harmonicas during a performance and can benefit from a quick switch. The magnetic force of the magnets is selected so that the musician can readily detach one harmonica from the magnetic cradle and exchange it for the second harmonica in an instant.

In another embodiment, the harmonica cradle is pivotable on the shoulder frame between a "playing position" (such that the cradle is proximate to the face of the musician and the harmonica is positioned for engaging the musician's mouth) and an "at-rest position" (such that the cradle and harmonica are out of the way). The holder allows the musician to pivot the harmonica between the two positions with minimal effort and time.

Advantageously, the pivot or hinge structure includes a "memory locking mechanism" so that as the apparatus is pivoted, the harmonica will "drop" or "lock" into a preferred, preset playing position the musician has selected in advance. Generally the apparatus includes mechanical means for adjusting the position of the harmonica to fit the musician's dimensions and performance style.

In yet another embodiment, a harmonica holder with magnetic cradle for hands-free playing of a harmonica includes a shoulder yoke adapted to wear the harmonica holder on the shoulders of a musician; a harmonica support frame or member to be worn in front of the musician, and a cradle riser section or strut centrally disposed on the support frame for supporting a harmonica cradle, the harmonica cradle comprising: i) a generally planar surface and a raised lip for engaging an anterioinferior aspect of the harmonica; and ii) a magnet disposed in the cradle. The magnet acts in concert with the lip to reversibly stabilize the harmonica during playing, and is configured with a pull force rated to hold the harmonica in the cradle (for hands-free playing in the cradle) and to release the harmonica when needed, generally acting in concert with the raised lip. The center pivot allows the harmonica and cradle to be pivotable between a playing position such that the harmonica cradle is proximate to the face of the musician and an at-rest position such that the harmonica cradle is displaced from the face. The center pivot of the cradle riser section is preferredly configured with a memory locking feature so that the musician can adjust, preset and lock in the playing position and return to it at any time.

Harmonica support holders of the invention are optionally configured with a "double elbow" for adjusting the playing position according the preference of the musician.

The foregoing and other objectives, features, and advantages of the invention will be more readily understood upon consideration of the following detailed description of the invention, taken in conjunction with the accompanying drawings, in which preferred embodiments of the invention are illustrated by way of example. It is to be expressly understood, however, that the drawings are for illustration and description only and are not intended as a definition of the limits of the invention. The invention does not necessarily reside in any one of these features taken alone, but rather in the particular combination of all of its structures for the functions specified.

Those skilled in the art will appreciate that the inventive concepts upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The teachings of the present invention are more readily understood by considering the drawings, in which:

FIG. 6 is a perspective view of the harmonica cradle and magnet of a cradle riser, without the harmonica.

FIGS. 7A,7B and 7C are component views of an operable locking memory hinge assembly on a cradle riser.

Figure 1:
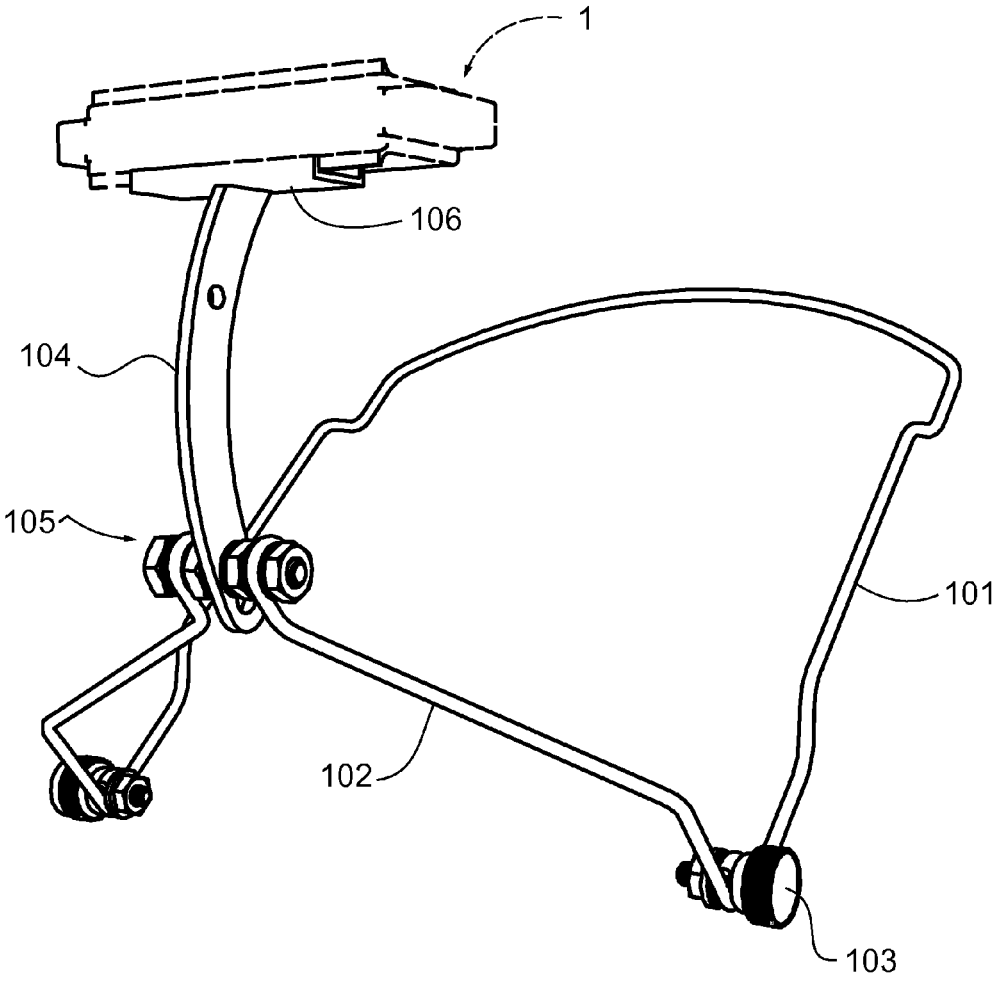
FIG. 1 is a perspective view of a first harmonica holder of the invention. The harmonica is magnetically secured in a magnetic cradle and the cradle is elevated in a "playing position". Also shown is a yoke which goes over the shoulders and behind the neck.

The drawings are not necessarily to scale. Certain features or components herein may be shown in schematic form and some details of conventional elements, such as nuts, washers and pins, are not shown in the interest of clarity and conciseness.

NOTATION AND NOMENCLATURE

Certain terms throughout the following description are used to refer to particular features, steps or components, and are used as terms of description and not of limitation. As one skilled in the art will appreciate, different persons may refer to the same feature, step or component by different names. Components, steps or features that differ in name but not in function or action are considered equivalent and not distinguishable, and may be substituted herein without departure from the invention. Certain meanings are defined here as intended by the inventors, i.e., they are intrinsic meanings. Other words and phrases used here take their meaning as consistent with usage as would be apparent to one skilled in the relevant arts.

The harmonica of the invention is not limited to a particular type of harmonica. Included are "diatonic", "chromatic", "tremolo", "orchestral" and "cheng gong" harmonicas, which have a sliding mouthpiece member.

"Diatonic harmonicas" are very common for blues, folk and street performances, and typically have a limited number of notes prescribed by the key signature. For example, a harmonica that is diatonic to C major has the notes C, D, E, F, G, A and B, but no sharps or flats; a harmonica that is diatonic to C# major has the notes C#, D#, E#, F#, G#, A# and B#, but no flats or naturals; and so on. Generally two reed plates are supplied, one for exhalation and the other for inspiration (also termed "draw"), where the various notes can be played only on one or the other reed. Thus several harmonicas may be needed to play a medley of musical pieces, or to change keys in the middle of a song.

Double reed diatonics such as octave and tremolo instruments, where each note is sounded by a pair of reeds are also known. Chromatics typically permit the performer to play a full musical scale, but are heavier and larger and may require a larger cradle and stronger magnet.

"Coverplates" are metal plates, generally of steel or other ferromagnetic material, that are fastened to the top and bottom of a harmonica comb, thereby serving as the outside top and bottom surfaces of the instrument, typically the surfaces contacted by the hand when played.

"Comb" and "soundbox" relate to the interior body of the harmonica that channels air to the reeds.

"Magnetic cradle" or "magnetic harmonica cradle" relate to a fixed support surface that has been magnetized so as to securely hold a harmonica on the support surface when played without hands. A lip is generally associated with the support surface and is configured to prevent the harmonica from slipping away from the mouth of the musician. A preferred magnetic cradle also permits the musician to grasp the harmonica in place, such as with a cupping motion for modulating the sound, or in a picking up motion for dismounting and/or exchanging the harmonica without the necessity for a mechanical release or latching mechanism which would slow the process or require tools and additional adjustment.

"Cradle riser" is a structural element of the frame which extends from a spanning member bridging the right and left arms of the neck or shoulder yoke to the harmonica. The cradle riser supports the magnetic cradle that holds the instrument. The cradle riser is provided with a hinge so that it may be rotated from an "at rest" position which is generally inverted or prone (relative to the hinge) to a playing position which is generally upright and elevated (relative to the hinge), thus providing a freespace whereby the musician is readily able to engage the mouthpiece of the harmonica. The cradle riser may be a "tee-shaped" element or a "rainbow arch" shaped element, while not limited thereto.

A "memory locking" feature refers to a harmonica holder pivot mechanism or assembly with detent so that the angle between the shoulder yoke and the harmonica support frame or cradle riser may be varied between an at-rest position and a playing position such that the angle is preset according to the musician's preference. The memory locking mechanism allows the musician to releasably lock the harmonica in a preferred playing position and to unlock the holder so that the harmonica can be angled away from the musician's mouth when not in use.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

"Conventional"—refers to a term or method designating that which is known and commonly understood in the technology to which this invention relates.

Unless the context requires otherwise, throughout the specification and claims which follow, the word "comprise" and variations thereof, such as, "comprises" and "comprising" are to be construed in an open, inclusive sense, that is as "including, but not limited to".

The appended claims are not to be interpreted as including means-plus-function limitations, unless such a limitation is explicitly recited in a given claim using the phrase "means for."

DETAILED DESCRIPTION

Referring to FIGS. 1 through 19, wherein like reference numerals refer to like components in the various views, there is illustrated a new and improved harmonica holder in several views and multiple embodiments, generally denominated 100, 200, 300 and 400 herein. In the various views, a harmonica is generally denominated as 1 throughout.

FIG. 1 is a perspective view of a first harmonica holder 100 of the invention. The harmonica holder is essentially a frame for supporting a harmonica 1, and includes a shoulder yoke member 101 which is supported on the shoulders or neck of the musician playing the harmonica; and a harmonica support member having a spanning section 102 joined to the shoulder yoke at right and left elbows 103 and a cradle riser section 104 hinged on the spanning section at central pivot 105.

The cradle riser includes a generally planar platform 106 with magnet, termed here a "magnetic harmonica cradle," for securing and supporting the harmonica in the "playing position", with harmonica upright and accessible to the musician. This apparatus permits the musician to play the harmonica without use of hands; the hands generally being kept free for playing a second instrument such as a guitar.

Figure 2:
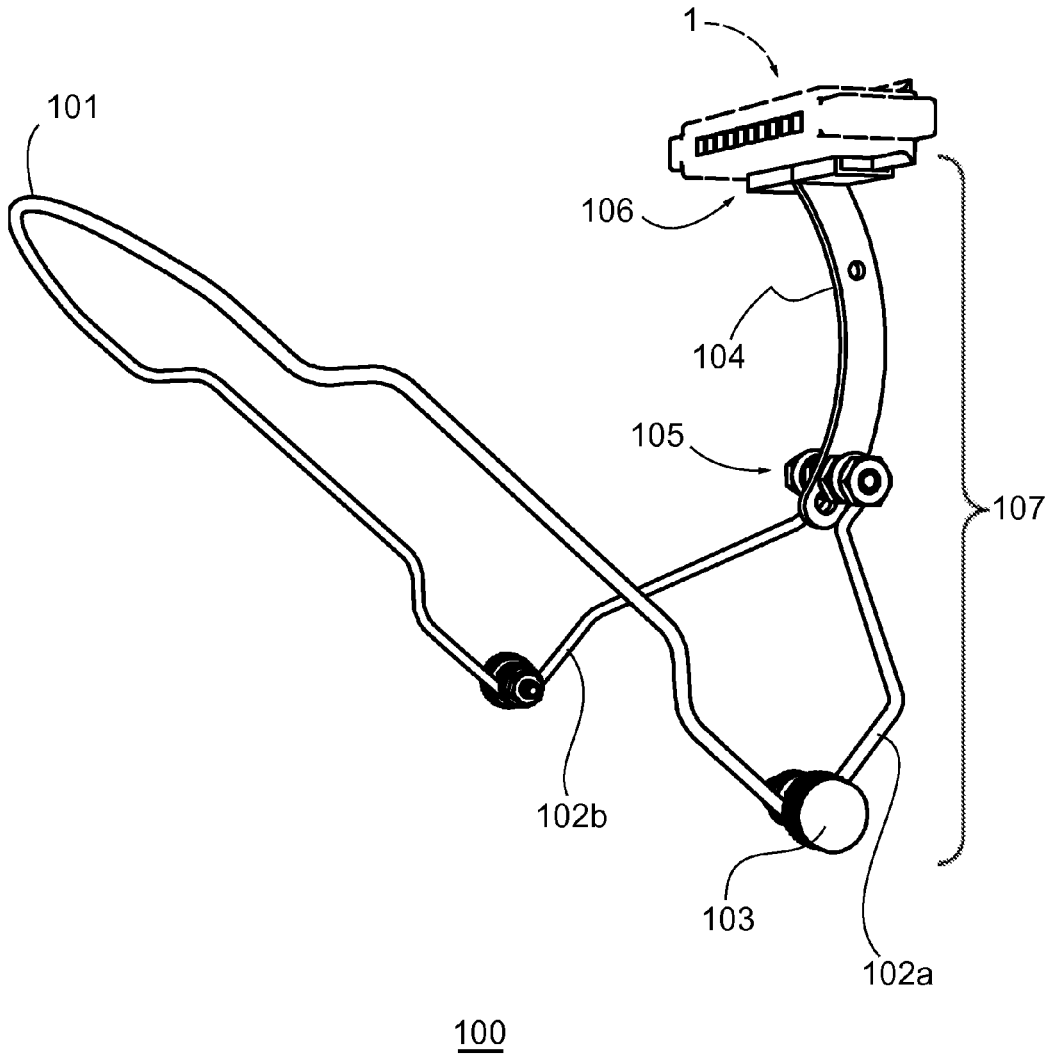
In FIGS. 2 and 3, the harmonica holder is rotated so that the apparatus can be seen from the perspective of the musician.
Figure 3:
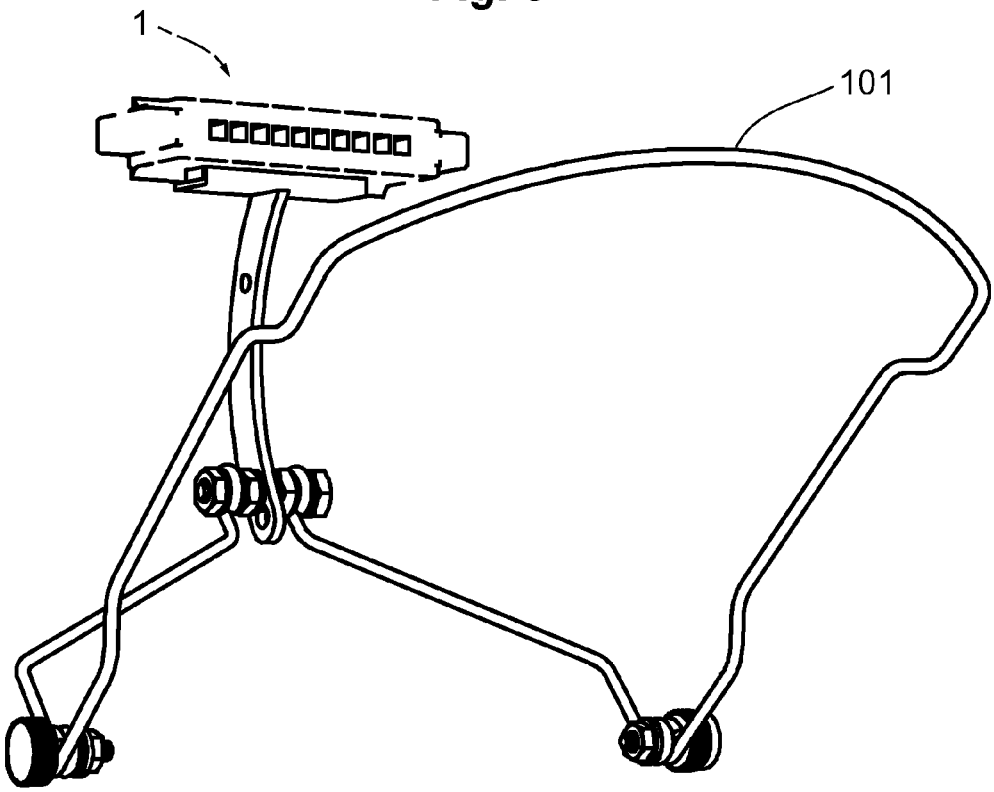

In FIGS. 2 and 3, the harmonica holder is rotated so that the apparatus can be seen from the perspective of the musician on whose neck and shoulders the shoulder yoke 101 rests.

As can be appreciated from FIG. 2, pivots 103 and 105 are both adjustable, thus the harmonica support member 107 is "double elbowed" and can be adjusted over a wide range of vertical positions to suit the user.

Pivot 105 is formed at the junction of a right spanning section 102*a* and a left spanning section 102*b* and may include a memory lock feature as will be described below.

FIG. 3 depicts the harmonica holder 100 rotated more as would be experienced by the user, with a hoop section of the shoulder yoke 101 slipped over the head as viewed from behind. The harmonica is in the upright playing position in proximity to the mouth of the musician in this view.

In an optional embodiment, not shown, the shoulder yoke may be formed of two separate pieces, each an inverted "U" or hook, one each to engage the right and left shoulders so that the apparatus is readily removed and is hooked on the shoulders, not the neck, if preferred.

Figure 4:
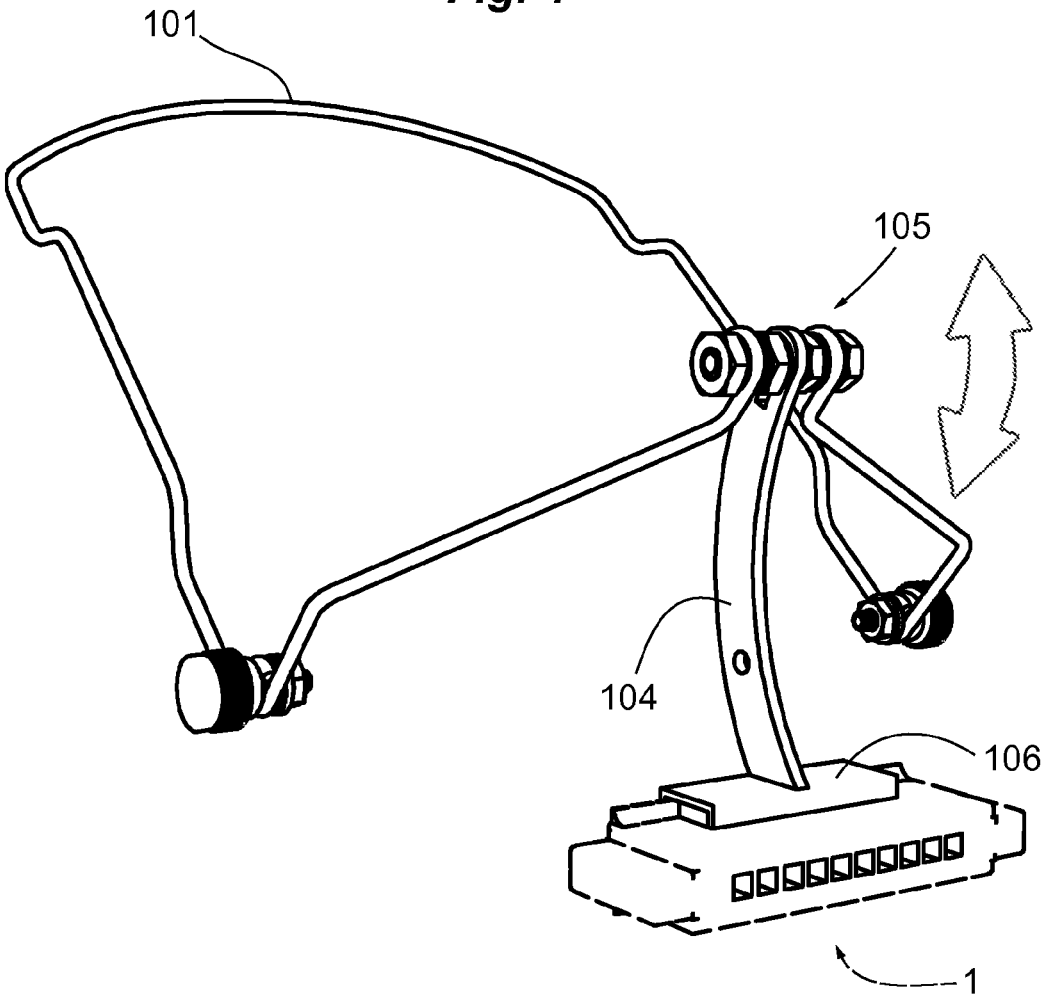
FIG. 4 illustrates the apparatus of the preceding figures, but the harmonica is in an "at-rest" position. A memory locking hinge permits the vertical strut to be repositioned (double arrow) between an upright and an inverted or reclining position.

FIG. 4 illustrates the apparatus of the preceding figures, but the harmonica is in an "at-rest" position. A memory locking hinge permits the cradle riser 104 to be repositioned (double arrow) between an upright and an inverted or reclining position.

The cradle riser section 104 is seen to rotate clockwise around pivot 105, and is shown in this view in an "at rest" position on the chest of the user. In the at-rest position, the harmonica is not in use, but is readily accessible when needed. The musician has only to rotate the cradle riser in the counterclockwise direction to bring the harmonica into the "playing position" as shown in FIG. 1. This motion is depicted by a double arrow. The harmonica (1) is magnetically secured in a magnetic harmonica cradle 106 and will not drop off the holder when inverted.

Figure 5:
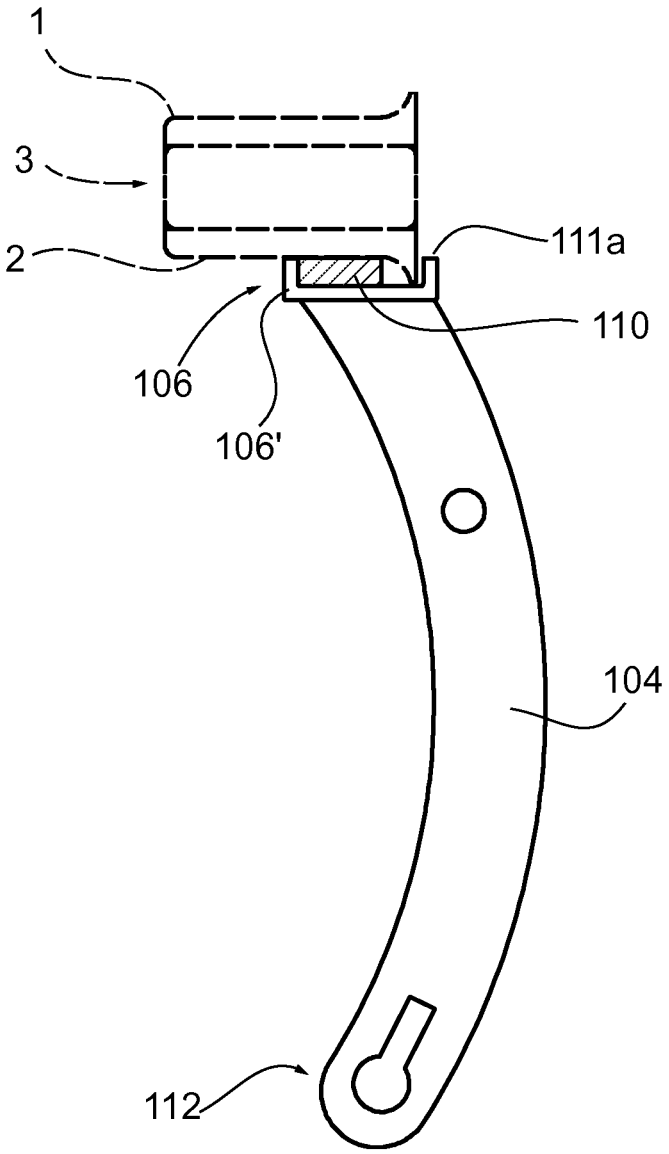
FIG. 5 is a detailed view of the cradle riser with vertical strut and harmonica cradle with magnet.

FIG. 5 is an elevation view of the cradle riser 104 and harmonica cradle assembly 106. Shown is the cradle assembly with a topmost channel bar 106*a*. A magnet 110 is secured in the channel. As can be appreciated in this side view, the bottom coverplate 2 of the harmonica 1 is magnetically affixed to the magnet 110. The anterior lip 111*a* of the channel bar engages the anterior lip of the harmonica to prevent slippage when the musician leans into the mouthpiece 3 of the harmonica. The surfaces can be padded if desired to prevent scratching. The vertical strut of the cradle riser may be curved to provide the musician better access to the mouthpiece.

FIG. 6 is a perspective view of the harmonica cradle and magnet, without the harmonica. Magnet 110 and channel bar 106*a* are assembled as magnetic harmonica cradle assembly 106. The musician has only to lay the harmonica in the cradle and the harmonica is retained by the magnetic action and by the groove of the channel. Surprisingly, the harmonica can be played in this position with no loss of acoustic properties and without hands.

FIGS. 7A, 7B and 7C are component views of an operable locking memory hinge assembly. FIG. 7A depicts the two primary components of the cradle riser assembly 104, a magnetic harmonica cradle 106 supported by a vertical strut. In side view, as shown in FIG. 7B in more detail, the cradle 106 supports magnet 110 and is bounded by anterior and posterior lips 111*a/b*. The vertical strut defines on its lower aspect a pivot opening 112 configured with memory slot mechanism, consisting here of a hub 113 for engaging an axle bolt and a locking keyway 114. FIG. 7C depicts a threaded axle bolt 115 with medial slot 115*a* and journalled surface for engaging the hub of the pivot opening 112.

Figure 8A:
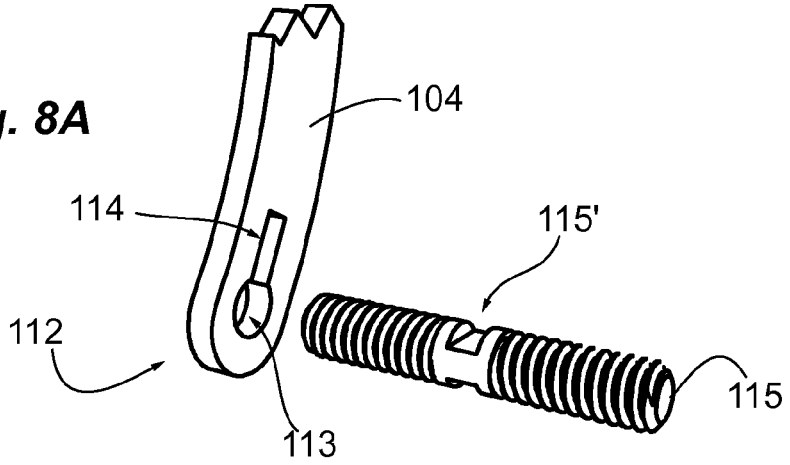
FIGS. 8A through 8C depict action views of a memory lock feature.
Figure 8B:
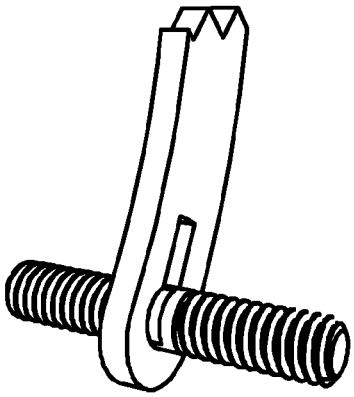
Figure 8C:
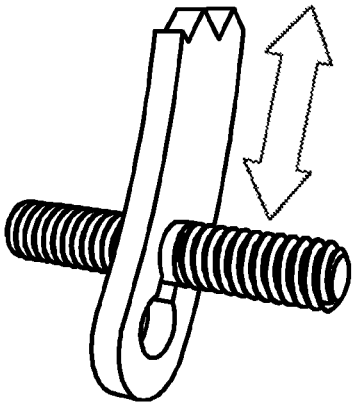

FIGS. 8A through 8C depict action views of a first memory lock feature. Strut 104 defining pivot opening 112 slides over slotted axle bolt 115 through hub 113. The center slot 115*a* in the bolt engages locking keyway 114 of the cradle riser in the locked position as shown in FIG. 8C, but the cradle riser is free to rotate between the playing position and the at-rest position as shown in FIG. 8B. The musician has only to lift the harmonica cradle and cradle riser from its locked position in FIG. 8C and so that the harmonica support member can rotate clockwise or counterclockwise on hub 113 and axle bolt 115.

The orientation of the slot 115*a* of the axle bolt is adjustable by the user with respect to center tabs in the right and left spanning members 102 (as evident in FIG. 1). Accessory fasteners can be used to tighten the axle bolt in its preferred position. The keyway 114 then "remembers" the pivot angle the user has selected and will return to it each time the keyway is engaged. This memory locking feature allows the musician to quickly return the harmonica to the playing position when needed. When the keyway is "dropped" onto the slot 115*a* as shown in FIG. 8C (double arrow), the harmonica is disengageably "locked" in the preferred upright playing position as adjustably configured by the user.

FIGS. 9 through 19 show alternative embodiments of the inventive apparatus. As will be readily appreciated, other variations on these exemplary structures may be constructed according the teachings of the invention.

Figure 9:
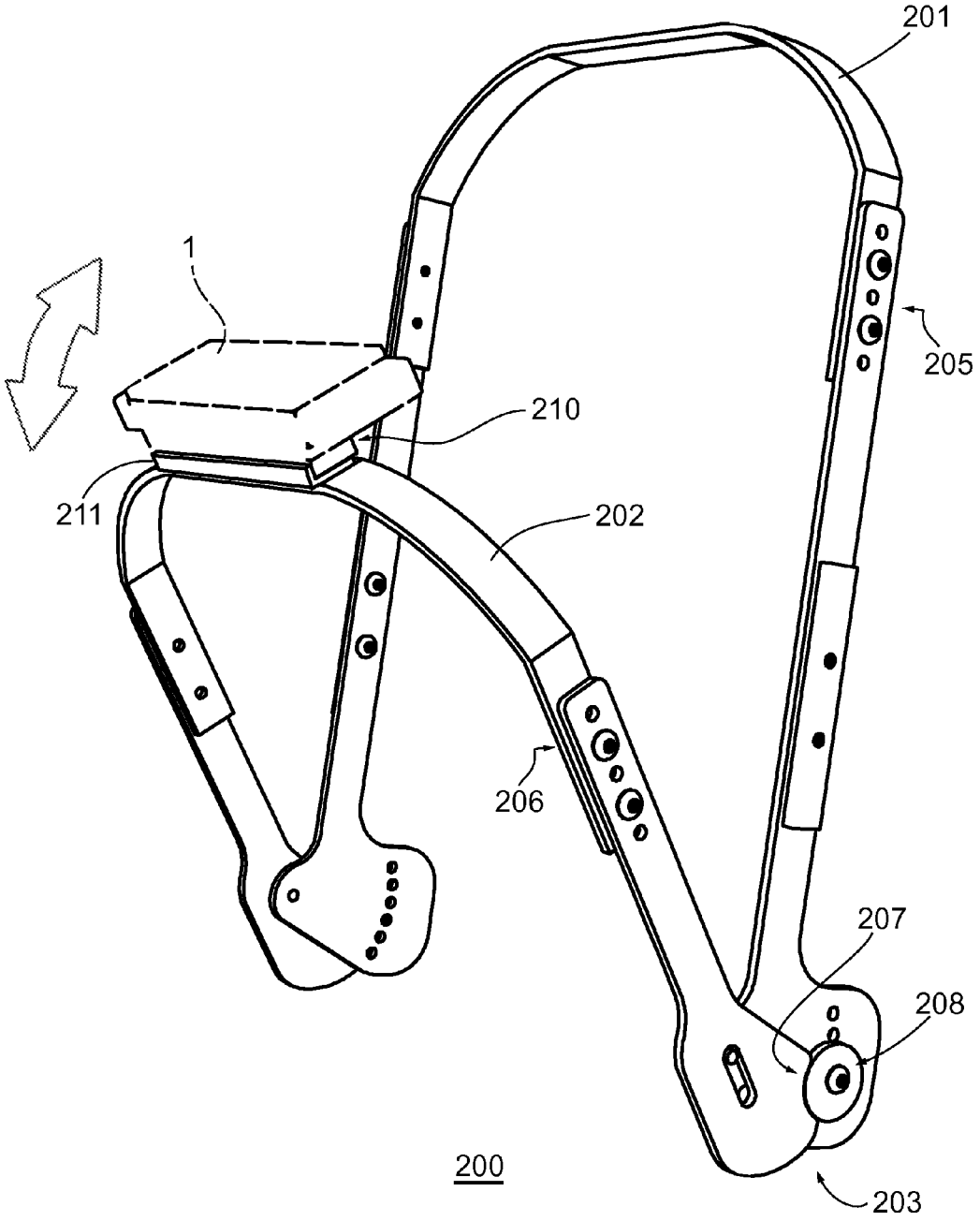
FIG. 9 is view of a second embodiment of the harmonica holder of the invention. The apparatus has a prominent hinge for raising and lowering the harmonica to and from the mouth. The hinge is provided with an alternative construction of a memory lock.

FIG. 9 is view of a second embodiment 200 of the harmonica holder of the invention. The apparatus includes two subassemblies, a shoulder hoop 201 and a harmonica support hoop or member 202. The two subassemblies of the frame are joined at pivot 203.

Both hoops of the frame are adjustable (205, 206) to fit the user. The hinge is provided with an alternative construction of a memory lock with locking cam or detent 207 and cam follower or detent wheel 208, as will be described below.

Magnet 210 is used for securing harmonica to the magnetic harmonica cradle 211, which rests on a "hooped" or "arched" section 202 of the frame that can be pivotably raised and lowered from the musician's mouth (double curved arrow). A bar magnet is shown in the cradle, but other forms of magnets may be used so as to secure the harmonica; alternatively the cradle may be formed of a magnetic member, for example, or the magnet may be attached to the outside of the cradle so that lines of magnetic force are conducted by a magnetically susceptible cradle material to magnetize the cradle.

Figure 10:
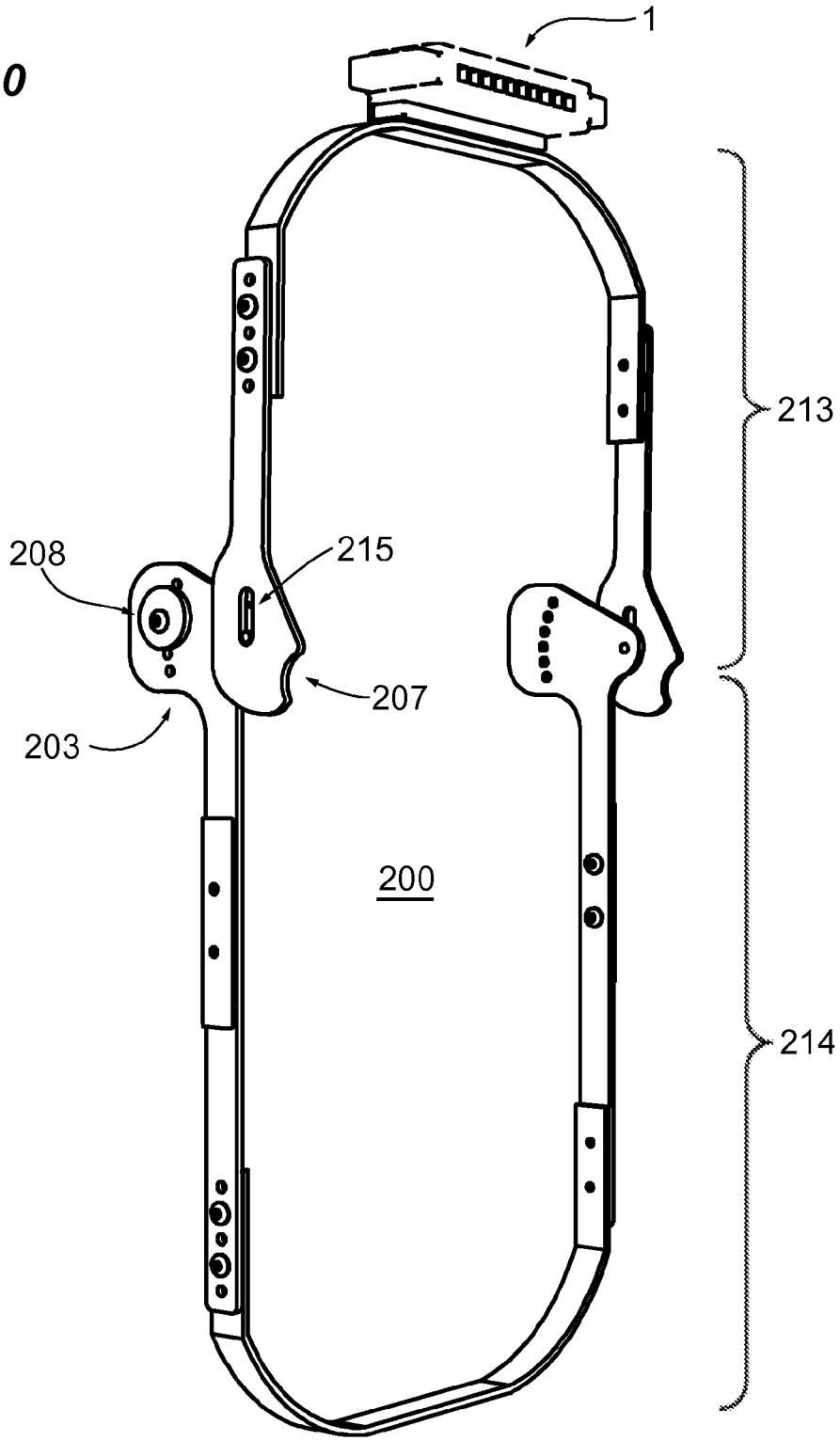
FIG. 10 depicts a harmonica holder that has been unfolded. Features of the memory locking hinge are illustrated. Features for adjusting the frame are also shown.

FIG. 10 depicts the harmonica holder 200 in an unfolded state. Features of the memory hinge are illustrated. Pivot 203 joins the harmonica support assembly 213 and the shoulder yoke assembly 214. The cam indent 207 is contoured and radiused to rotate and engage the cam follower wheel 208 at a preselected angle (shown in the engaged position in FIG. 9).

Figure 11A:
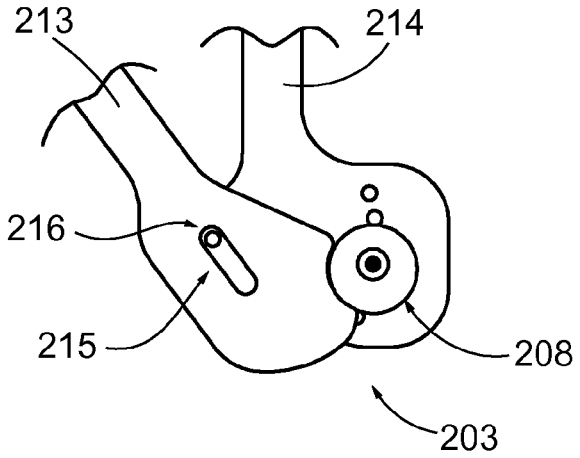
FIGS. 11A, 11B and 11C are action views of a hinge with memory lock.

Slot 215 functions analogously to the keyway 114 of FIG. 7. This is shown in more detail in FIGS. 11A-11C. Three action views depict, respectively, the hinge in a locked, released, and relaxed position. Cam wheel 208 can rotate freely and is a part of the shoulder yoke assembly 214. In FIG. 11A, slot 215 is seen to ride on pin 216. The cam surface 207

(FIG. 11B) of the magnet support arm 213 fully engages and locks on the cam wheel 208. In this position, the harmonica is rigidly positioned in the playing position, essentially as shown in FIG. 9.

Figure 11B:
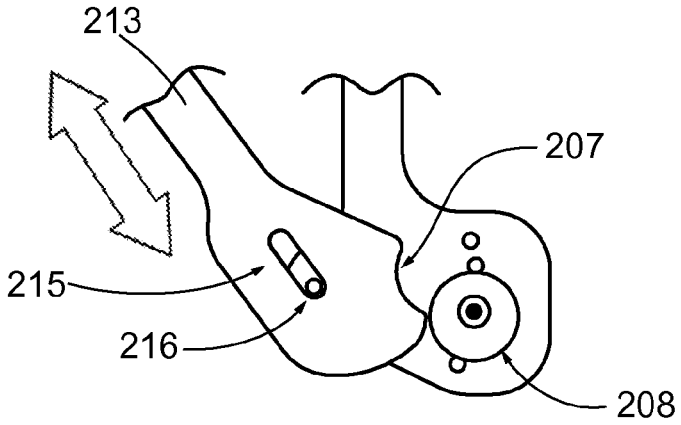
Figure 11C:
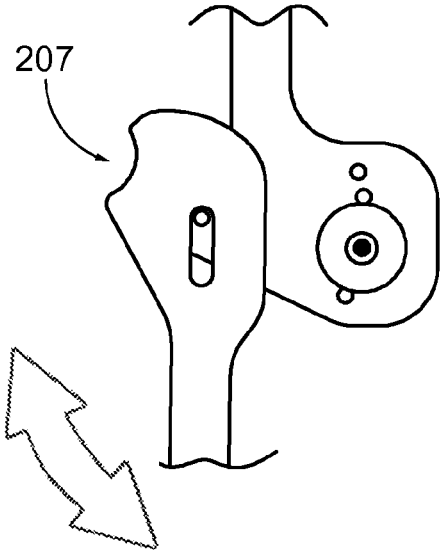

By lifting the harmonica support arm 213 on pin 216 away from the cam follower wheel 208 as shown (double arrow) in FIG. 11B, the hinge 203 can be unlocked to pivot. Slot 215 is guided on pin 216 in making this motion. The cam surfaces can then be rotated counterclockwise (away from the chest), allowing the harmonica to drop away from the musician's mouth. In FIG. 11C, the harmonica support arm 213 is in an inverted position "at-rest", with the harmonica hanging down. By reversing these motions (double arrows), first by rotating the inverted support arm 213 clockwise, then by dropping the slot 215 onto pin 216 to engage the cam follower wheel, the harmonica can be returned to the locked "playing" position. Thus this mechanism serves as a second variant of a memory lock feature.

Figure 12:
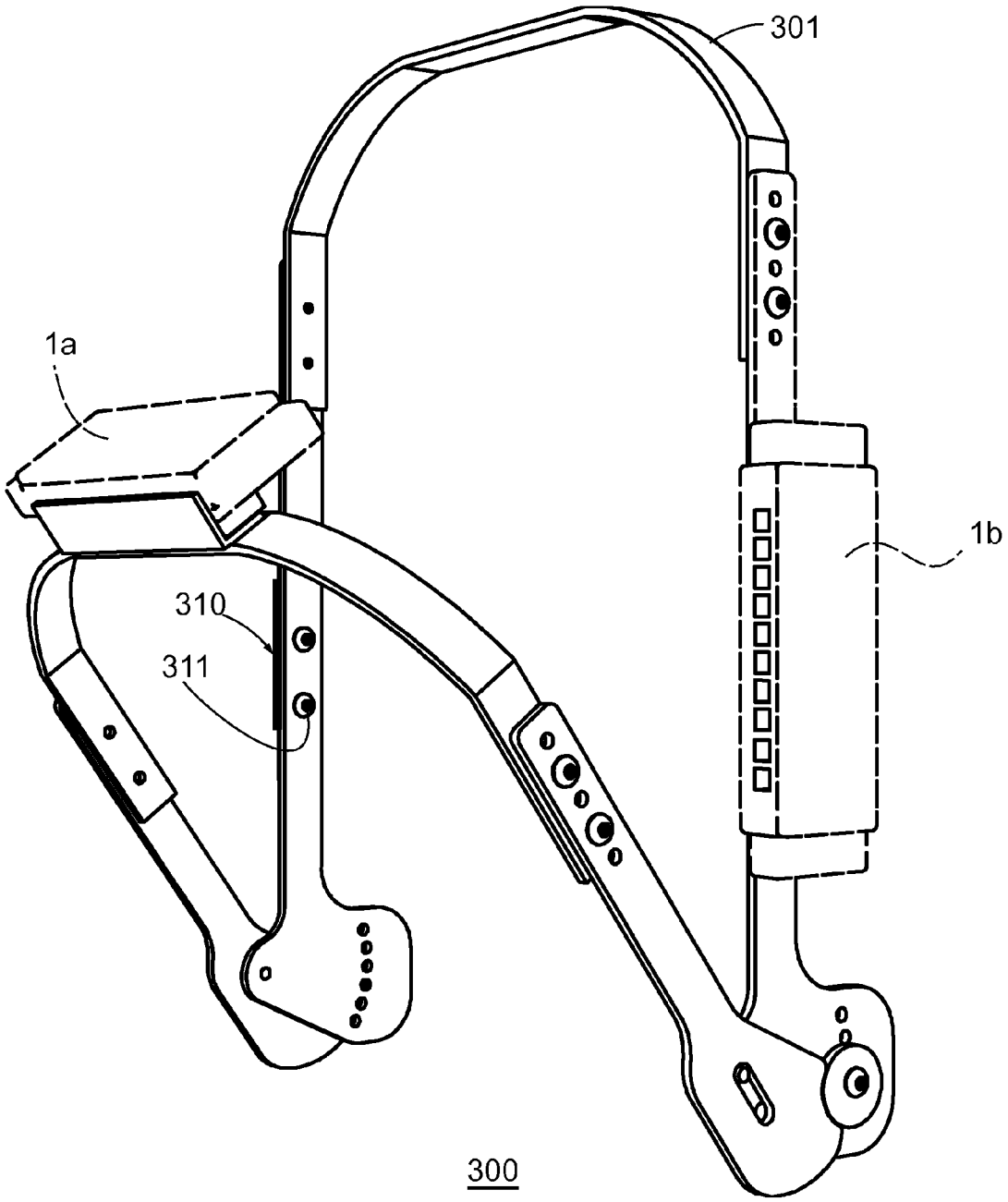
FIG. 12 is a view of an embodiment 300 of the invention configured for two harmonicas (1*a*, 1*b*), where the harmonicas can be quickly exchanged. Both harmonicas are magnetically secured to the frame.

FIG. 12 is a view of an embodiment 300 of the invention configured for two harmonicas 1*a*, 1*b*, where the harmonicas can be quickly exchanged. Both harmonicas are magnetically secured to the frame. A second magnet 310 is secured to the shoulder yoke by fasteners 311. The second magnet may be secured to the right or the left arm of the shoulder yoke, or as shown here, magnets may be attached to both arms. Alternatively, a single harmonica may be held on one of the magnets, and an alternate instrument such as a microphone or whistle may be disposed on the other magnet, so that the harmonica and the alternate instrument conveniently may be swapped into the magnetic cradle at will.

Figure 13:
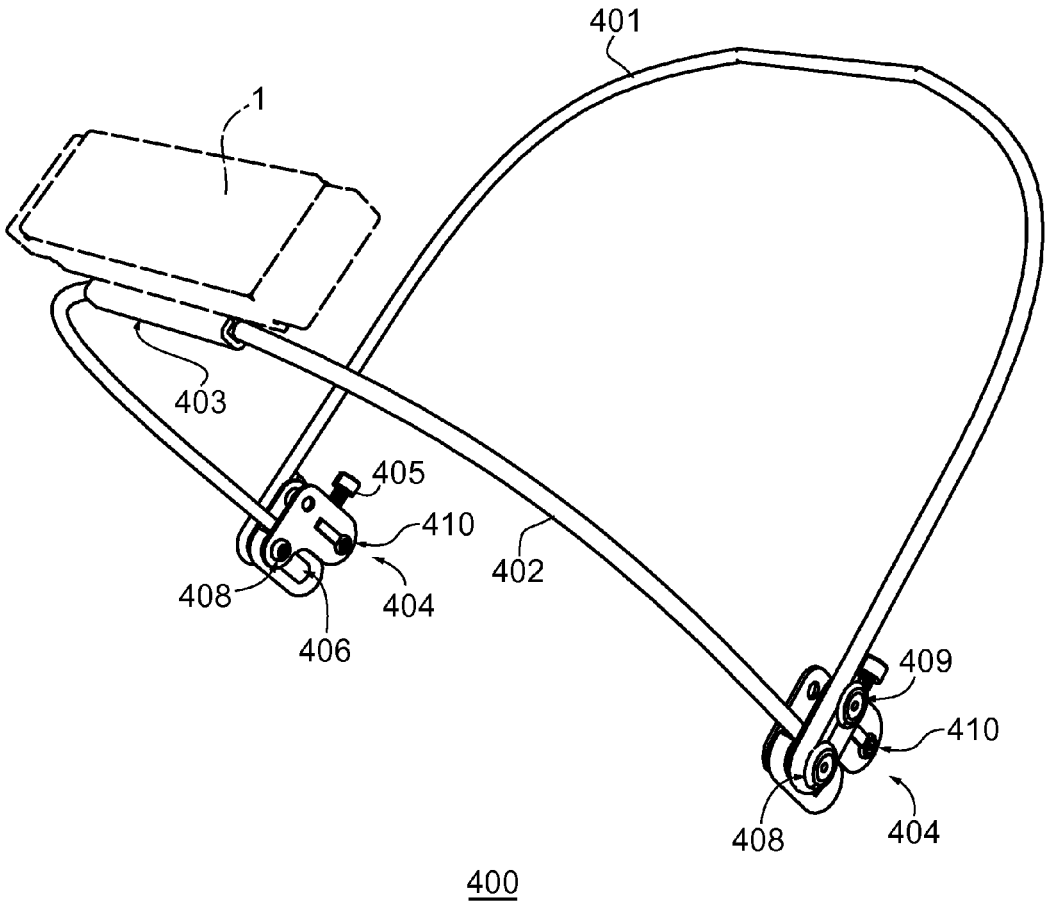
FIG. 13 is a perspective side view of yet another embodiment, harmonica holder 400 of the invention, the embodiment having a wire frame with memory locking hinge and adjustable detents.

FIG. 13 is a perspective view of yet another embodiment, harmonica holder 400 of the invention, the embodiment having a wire frame with memory locking hinge and adjustable detents. Shown are shoulder yoke 401 and harmonica support frame 402. Also shown is harmonica cradle 403, which is covered in part by harmonica 1. Shoulder yoke 401 and support frame 402 are joined at pivot assemblies 404, which comprise an adjustable memory locking hinge with detent screws 405. Support frame 402 is a wireframe and is bent at the pivot to form a slot 406 that wraps around a slideable hub member (secured in place by rivet 408), as will be described in more detail below. The shoulder yoke is secured to the pivot member 404 by two rivets, 409 and 410. For ease in manufacture, the two wire frames are identical component parts.

Figure 14:
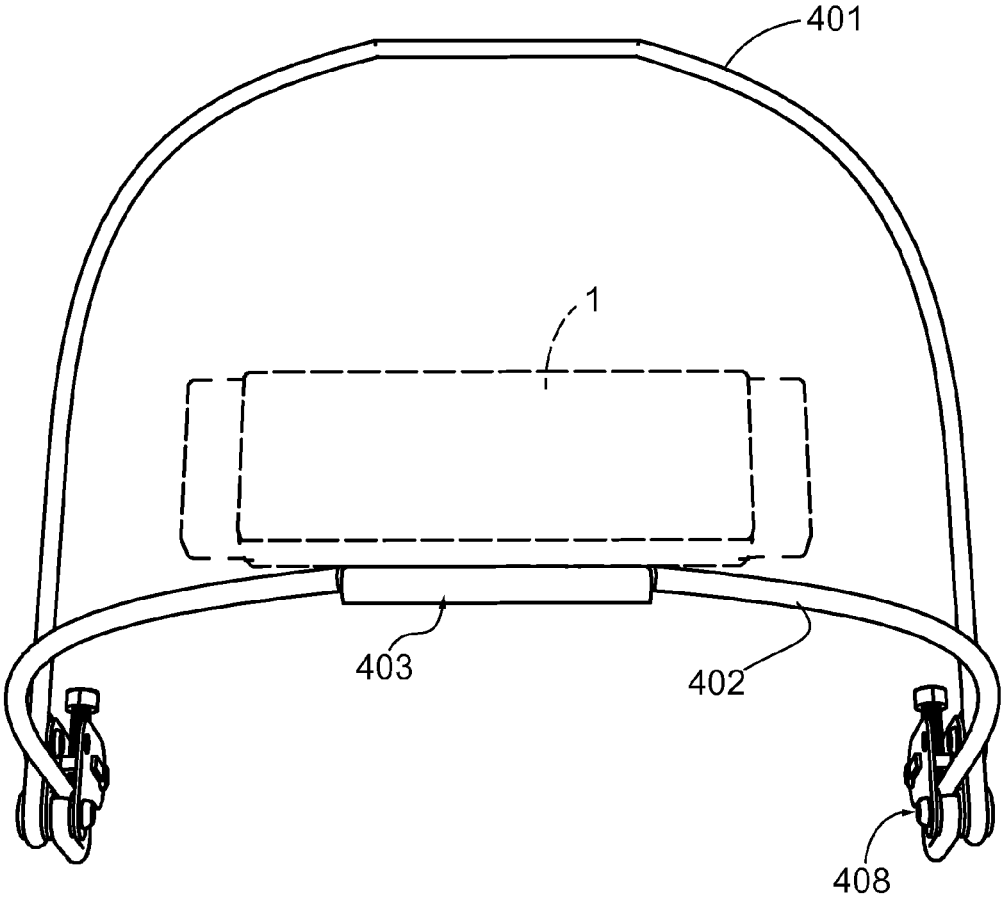
FIG. 14 is a perspective front view of harmonica holder 400, showing yet another embodiment of a magnetic cradle and memory locking hinge.

FIG. 14 is a perspective front view of harmonica holder 400. Shoulder yoke 401 is shown generally in the plane of the page; support frame 402 appears to extend toward the viewer out of the page. The wire frames pivot with respect to each other on a hub assembly indicated by the position of rivet 408.

Figure 15:
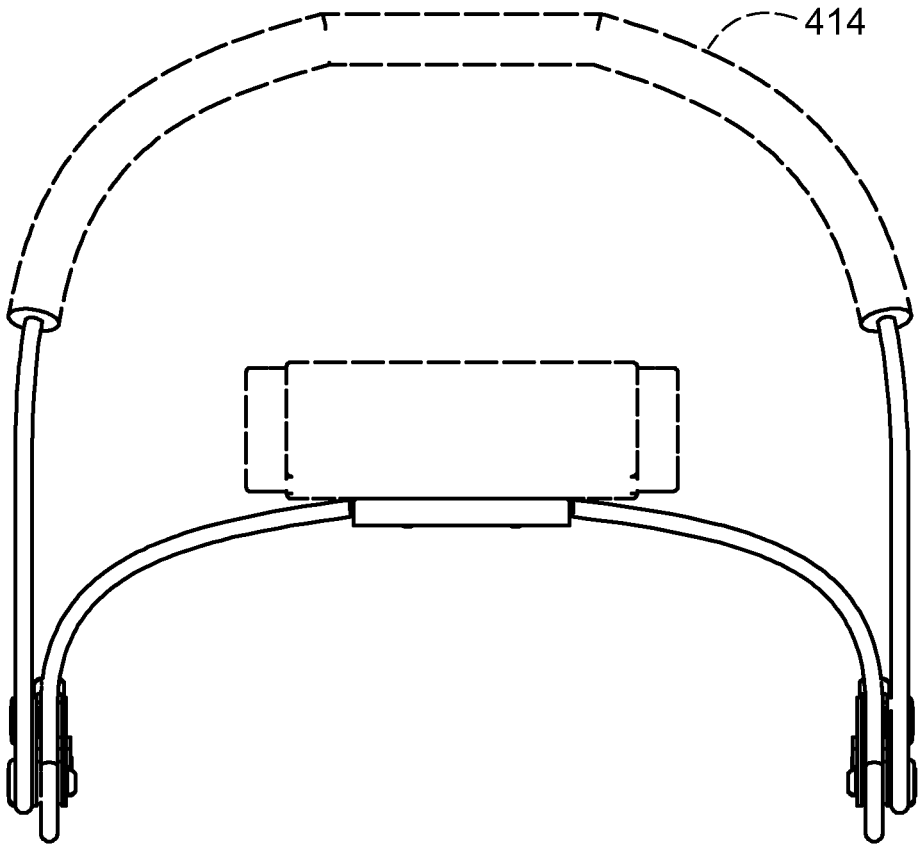
FIG. 15 is a perspective rear view of harmonica holder 400.
Figure 16:
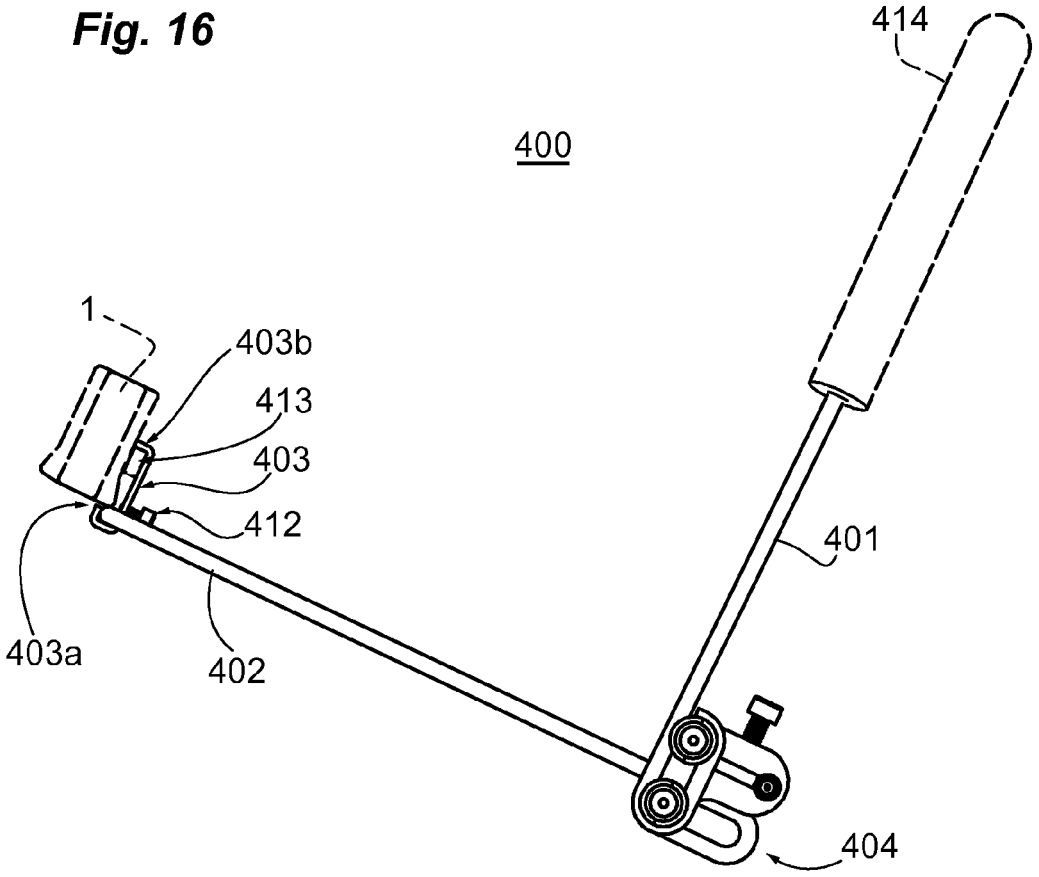
FIG. 16 is a side view of harmonica holder 400.

FIG. 15 is a rear view of harmonica holder 400 showing the overall structure and appearance. FIG. 16 is a side view of harmonica holder 400 showing the overall structure and appearance. The harmonica is mounted in the magnetic cradle so that an anterioinferior aspect of the harmonica coverplate is braced against an anteriosuperior raised lip 403*a* of the cradle 403. A neck cushion 414 is illustrated, as would be used for comfort. The neck cushion could be a sculptured foam piece or tubular as indicated conceptually, and could be wrapped in a leather finish, for example.

Figure 17:
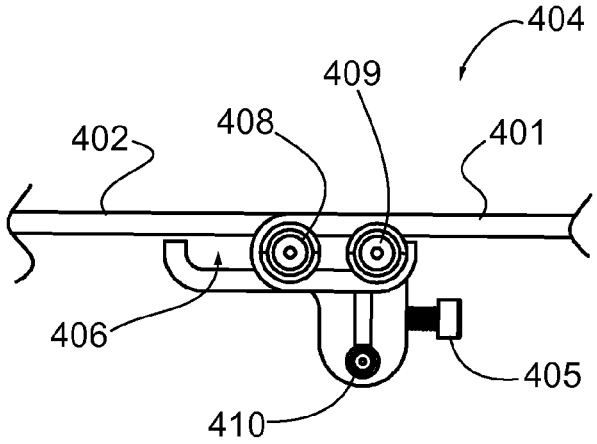
FIG. 17 is a detail view of a first hinge assembly of harmonica holder 400.

Magnetic cradle 403 is shown to be a bent plate in this embodiment and is secured to the support frame 402 with the aid of a lock nut 412. Loosening the lock nut (or nuts) enables the cradle to be tilted relative to the mouth so that the musician can optimize the position of the mouthpiece when the harmonica is pivoted up into the play position. Also shown in this view is a bar magnet 413 positioned within the cradle against a backside lip 403*b*. Memory locking hinge 404 is shown in side view at a 90 degree pivot angle and again in FIG. 17 at 180 degree pivot angle. In FIG. 17, the hinge assembly is shown in more detail; in this view the harmonica holder is laid flat so that shoulder yoke arm 401 and harmonica support arm 402 are in parallel.

Figure 18:
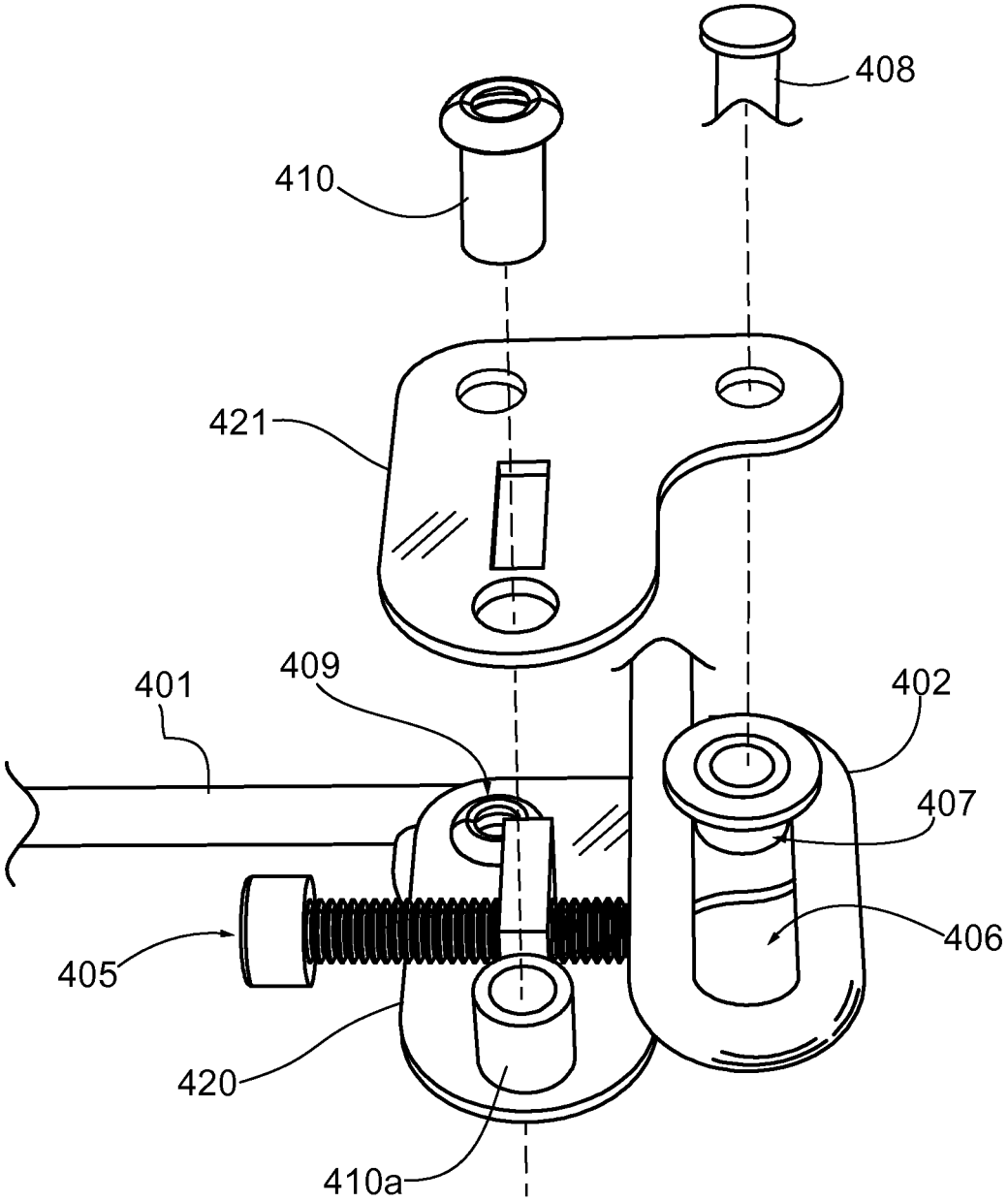
FIG. 18 is an exploded view of a hinge assembly with memory locking hinge.

FIG. 18 is an exploded view of a hinge assembly with memory locking hinge. The hinge assembly comprises two hingeplates (420, 421) and three rivets (408, 409, 410). Rivet 410 includes standoff 410*a* between the plates and stabilizes the hinge assembly. Hingeplate 420 is affixed to the shoulder yoke 401 by rivets 408 and 409; hingeplate 421 is affixed to the second wireframe 402 on a pivot hub 407, which is mounted in slot 406 and held in place by rivet 408. Detent screw 405 arrests the angular position of the support frame 402 and is preset by the musician to "remember" the preferred angle between the two wire frames, resisting clockwise motion of the harmonica cradle around hub 407. The detent screw engages support frame 402 only when in the playing position, and when disengaged, the two wireframes are free to pivot.

Figure 19A:
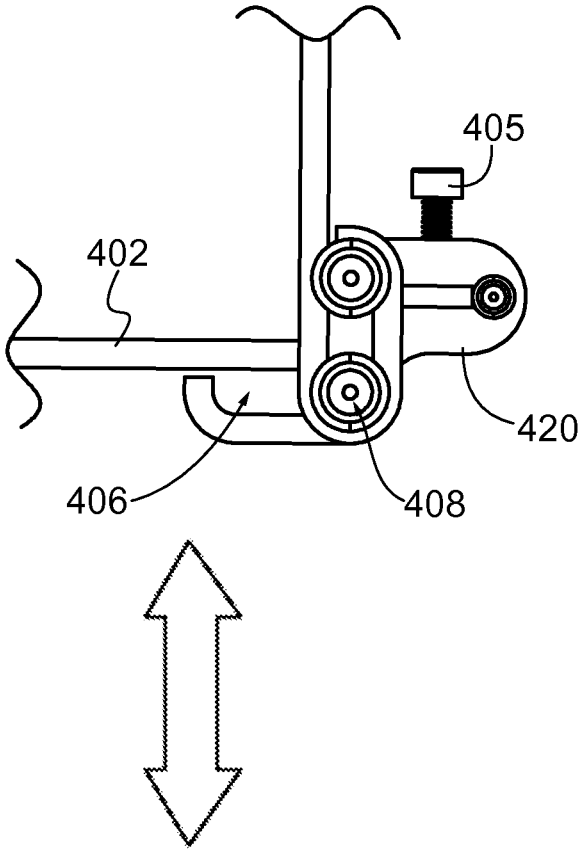
FIGS. 19A and 19B depict the memory locking slot action of the hinge assembly depicted in FIG. 18.
Figure 19B:
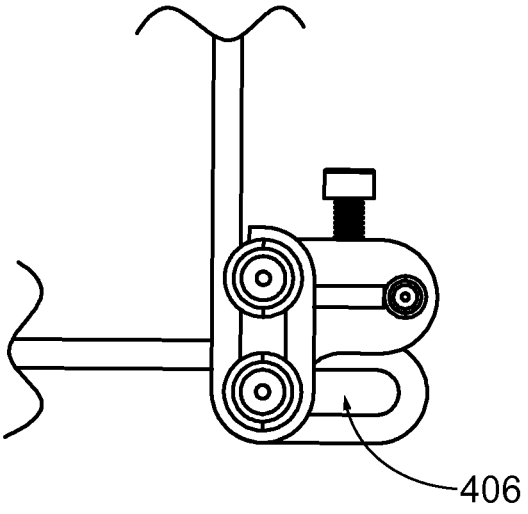

FIG. 19 depicts the memory locking action of the hinge assembly depicted in FIG. 18. In FIG. 19A, the harmonica support frame 402 is free to rotate and hub rivet 408 has been positioned in slot 406 so that detent 405 does not engage. In FIG. 19B, the hub rivet has been repositioned in slot 406 so that detent 405 engages the harmonica support member 402. Thus FIG. 19B represents the memory lock configuration of the detent mechanism corresponding to the harmonica "playing position" and FIG. 19A demonstrates how the musician disengages the detent (before rotating the harmonica away from his mouth and face to the "at rest" position).

All of the U.S. patents, U.S. patent application publications, U.S. patent applications, foreign patents, foreign patent applications and non-patent publications referred to in this specification and related filings are incorporated herein by reference in their entirety.

From the above disclosure, a skilled artisan will be able to practice the invention as described and shown, and to construct new embodiments and variants thereof. While there is provided herein a full and complete disclosure of the preferred embodiments, the invention is not limited to the exact construction, dimensional relationships, and operation shown and described. Various modifications, alternative constructions, changes and equivalents will readily occur to those skilled in the art and may be employed, as suitable, without departing from the true spirit and scope of the invention. Such changes can involve alternative materials, components, structural arrangements, sizes, shapes, forms, functions, auxiliary operational features or the like.

Therefore, the above description and illustrations should not be construed as limiting the scope of the invention, which is defined by the appended claims. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

What is claimed is:

1. A magnetic harmonica cradle, which comprises:

a) a cradle member enabled to supportingly engage a harmonica on a superior medial aspect thereof, said cradle member having a generally planar upper surface, wherein said planar upper surface is bounded by a harmonica-bracing anteriosuperior raised lip adapted to stop an anterioinferior aspect of a harmonica from sliding when engaged thereon; and, b) a magnetic member operatively engaging said cradle member, said magnetic member having a magnetic pull force configured to act cooperatively with said anterio-superior raised lip so as to reversibly hold a harmonica in said cradle member during hands-free playing and to release a harmonica when exchanging one harmonica for another.

2. The magnetic harmonica cradle of claim 1, further comprising a support member enabled to secure and support a harmonica in a playing position.

3. The magnetic harmonica cradle of claim 2, wherein said support member is a cradle riser strut.

4. The magnetic harmonica cradle of claim 1, wherein said magnetic pull force is an effective pull force such that a harmonica magnetically secured to said magnetic harmonica cradle will not drop off when the cradle is inverted.

5. The magnetic harmonica cradle of claim 1, wherein said magnetic pull force is rated for holding 7 to 15 pounds.

6. The magnetic harmonica cradle of claim 1, wherein said magnetic member is a bar magnet.

7. The magnetic harmonica cradle of claim 1, wherein said cradle member is composed of a magnetically susceptible material.

8. The magnetic harmonica cradle of claim 1, wherein said cradle member and a harmonica engaged thereon are configured to be cupped by a musician's hand for sound-modulated play.

9. The magnetic harmonica cradle of claim 2, wherein said cradle member, said support member, and in combination, a harmonica engaged thereon, are configured to be cupped by a musician's hand for sound-modulated play.

* * * * *